US007277556B2

(12) United States Patent
Akino

(10) Patent No.: US 7,277,556 B2
(45) Date of Patent: Oct. 2, 2007

(54) VIBRATING PLATE OF DYNAMIC MICROPHONE, METHOD OF MANUFACTURING THE VIBRATING PLATE AND DYNAMIC MICROPHONE COMPRISING THE SAME

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 413 days.

(21) Appl. No.: 10/997,362

(22) Filed: Nov. 23, 2004

(65) Prior Publication Data

US 2005/0135649 A1 Jun. 23, 2005

(30) Foreign Application Priority Data

Dec. 18, 2003 (JP) ..... 2003-420840

(51) Int. Cl.
*H04R 25/00* (2006.01)

(52) U.S. Cl. ..... 381/430; 381/424; 381/426

(58) Field of Classification Search ..... 381/170, 381/177, 398, 407, 423, 424, 426, 430, 369; 181/166, 167, 170, 171, 173, 164; 29/594, 29/609.1

See application file for complete search history.

(56) References Cited

U.S. PATENT DOCUMENTS 3,616,529 A * 11/1971 Iding ..... 29/594
6,154,556 A * 11/2000 Takahashi et al. ..... 381/430
6,570,995 B2 * 5/2003 Ohashi et al. ..... 381/430

FOREIGN PATENT DOCUMENTS

JP 04-115696 4/1992

* cited by examiner

*Primary Examiner*—Huyen Le
(74) *Attorney, Agent, or Firm*—Welsh & Katz, Ltd.

(57) ABSTRACT

It is an object to provide a vibrating plate of a dynamic microphone and a method of manufacturing the vibrating plate, the vibrating plate having a sub-dome and a center dome to which a voice coil is bonded by an adhesive. A mechanical intensity of the vibrating plate is increased without the vibrating plate formed to a double structure, as well as having an enhanced shock-resistance. According to FIG. 1*e*, a vibrating plate 1 of a dynamic microphone includes a center dome 10 with an electricity generating voice coil 30 and a sub-dome 20 connecting and communicating with the outer circumference of the center dome 10. The voice coil 30 is bonded to the center dome 10 with a first ultraviolet curing-resin 50 which has relatively high viscosity before hardening and relatively low hardness after hardening. A reinforcing resin layer 60*a* is integratedly formed in the inner surface of the center dome. The reinforcing resin layer 60*a* is formed with a second ultraviolet curing-resin 60 which has relatively low viscosity before hardening and relatively high hardness after hardening.

14 Claims, 3 Drawing Sheets

VIBRATING PLATE OF DYNAMIC MICROPHONE, METHOD OF MANUFACTURING THE VIBRATING PLATE AND DYNAMIC MICROPHONE COMPRISING THE SAME

FIELD OF THE INVENTION

The present invention relates to a vibrating plate and a method of manufacturing the vibrating plate. More particularly, the invention relates to an increased mechanical intensity of a center dome of the vibrating plate and relates to a measure of fixing a voice coil to the center dome.

BACKGROUND OF THE INVENTION

As shown in FIG. 4, a dynamic microphone generally uses a vibrating plate formed with synthetic resin such as polyethylene or polyester. The vibrating plate includes a center dome 10 and a sub-dome 20 which connects and communicates with the outer circumference of the center dome 10 as to elastically supports the center dome. (see Japanese Patent Application Publication No.4-115696).

A voice coil 30 for generating electricity is installed on the center dome 10 with an adhesive or the like. The voice coil 30 is disposed in a magnetic gap (not shown) and the coil as well as the center dome 10 is vibrated by arriving sound waves in the magnetic gap so that the sound waves are converted to an electric signal.

Therefore, the center dome 10 undertakes an important role to increase a conversion efficiency and to improve a frequency response of the dynamic microphone. Especially, in order to obtain a good frequency response in high frequencies, the center dome 10, not only, should have a high mechanical intensity, but also, should mechanical-strongly bond the voice coil 30.

The vibrating plate 1 is driven by sound waves. If the mechanical intensity of the center dome 10 is low, a deformation of the center dome 10 generates a transfer loss against the voice coil 30. If an adhesive which bonds the voice coil 30 to the center dome 10 has a low hardness, another transfer loss occurs at the bonded portion between the dome and the coil.

As one of measures of strengthening the mechanical intensity of the center dome 10, it is known that the center dome 10 is formed to a double structure with a dome-shaped applying plate (sheet) applied to the center dome 10, and the transfer loss at the bonded portion between the center dome 10 and the voice coil 30 can be solved by using an adhesive having a high hardness after the adhesive has hardened.

However, since the double structure of the center dome needs the additional applying plate and an additional manufacturing step to apply the applying plate, it is not preferable regarding to a cost. When the adhesive having the high hardness after the adhesive has hardened is used to bond the vibrating plate 30 to the center dome 10, the bonded portion is non-resistant against a strong shock received from outside due to the high hardness of the adhesive, and it is another problem to occur that the bonded portion comes off easily.

SUMMARY OF THE INVENTION

It is one object to provide a vibrating plate of a dynamic microphone, the vibrating plate having a center dome on which a voice coil is bonded by an adhesive, and a sub-dome. A mechanical intensity of the vibrating plate is increased without the vibrating plate formed to a double structure, as well as having an enhanced shock-resistance.

It is another object to provide a method of manufacturing the vibrating plate.

In order to carry out the object, as a first aspect of the invention, the vibrating plate of the dynamic microphone has the center dome on which an electricity generating voice coil is fixed by an adhesive and the sub-dome which connects and communicates with the outer circumference of the center dome. It is characterized in that as the adhesive for bonding the voice coil to the center dome, a first ultraviolet curing-resin which has relatively high viscosity before hardening and relatively low hardness after hardening is used and a reinforcing resin layer formed with a second ultraviolet curing-resin which has relatively low viscosity before hardening and relatively high hardness after hardening is integratedly formed on the inner surface of the center dome.

In the first aspect, it is preferable that the first ultraviolet curing-resin has a viscosity of 2000 cps±500 cps before hardening and a hardness of Shore D-scale 40±10 after hardening. The second ultraviolet curing-resin has a viscosity of 300 cps±100 cps before hardening and a hardness of Shore D-scale 80±20 after hardening.

It is further characterized in that the reinforcing resin layer is so formed as to cover the bonded porting between the center dome and the voice coil in order to enhance the shock-resistance.

The first aspect of the invention includes a dynamic microphone comprising the vibrating plate above-described.

A second aspect of the invention is to provide the method of manufacturing the vibrating plate of the first aspect. As the second aspect, in the method of manufacturing the vibrating plate of the dynamic microphone including the center dome on which the electricity generating voice coil is fixed by the adhesive and the sub-dome which connects and communicates with the outer circumference of the center dome, it is characterized in that the method includes a fist step of fixing the voice coil to the center dome by the first ultraviolet curing-resin which has relatively high viscosity before hardening and relatively low hardness after hardening, and a second step of temporally fixing the vibrating plate mounting the voice coil on a rotating pedestal by predetermined fixing means with the inner surface of the vibrating plate facing up, and a third step of applying the second ultraviolet curing-resin which has relatively low viscosity before hardening and relatively high hardness after hardening on the center portion of the inner surface of the center dome, and a fourth step of spreading the second ultraviolet curing-resin along the inner surface of the center dome to form a thin film by a centrifugal force with the rotating pedestal rotated, and a fifth step of hardening the second ultraviolet curing-resin formed to the thin film to form the reinforcing resin layer by emitting ultraviolet rays.

In the second aspect, it is preferable that a step of conforming the second ultraviolet curing-resin to the inner surface of the center dome due to leaving the resin spreading in a predetermined time without the rotation of the rotating pedestal is achieved between the third and the fourth steps.

It is preferable that the fourth step is executed while the vibrating plate is rotated at a rotating speed of 10 rpm to 500 rpm and in the fifth step the ultraviolet rays are emitted while the rotating pedestal is rotated.

According the present invention since the reinforcing resin layer formed with the second ultraviolet curing-resin which has relatively low viscosity before hardening and relatively high hardness after hardening is integratedly formed in the inner surface of the center dome, the vibrating plate having the improved high frequency response can be provided by increasing the mechanical intensity of the center dome without an applying plate to the center dome.

The center dome and the voice coil are bonded by the first ultraviolet curing-resin which has relatively high viscosity before hardening and relatively low hardness after hardening so that the bonded portion between the dome and the coil has the increased shock-resistance. Further, the reinforcing resin layer is formed as to cover the bonded portion so that the bond of the center dome and the voice coil is enhanced.

DETAILED DESCRIPTION OF THE PREFERRED EMBODIMENTS

Figure 4:
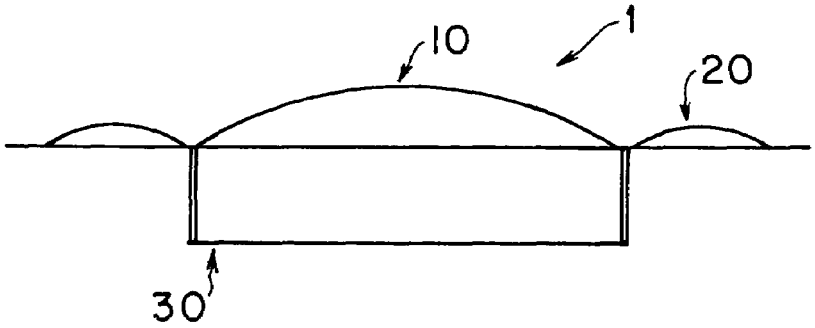
FIG. 4 PRIOR ART
FIG. 4 is a side elevation view illustrating a vibrating plate used in a dynamic microphone of a prior art.

According to FIGS. 1*a*, 1*b*, 1*c*, 1*d* and 1*e* explaining manufacturing steps of a vibrating plate of the invention, an embodiment of the present invention will be described. The present invention is not restricted to this embodiment. The basic constitution of the vibrating plate of the invention can be the same as that described before referring to FIG. 4. The same reference numerals as that of FIG. 4 are used in the explanation of the embodiment that is, the vibrating plate of the invention is formed with synthetic resin such as polyethylene or polyester and the plate includes a center dome 10 and a sub-dome 20 which elastically supports the center dome 10 and which connects and communicates with the outer circumference of the center dome 10. An electricity generating voice coil 30 is mounted on the center dome 10.

Figure 1A:
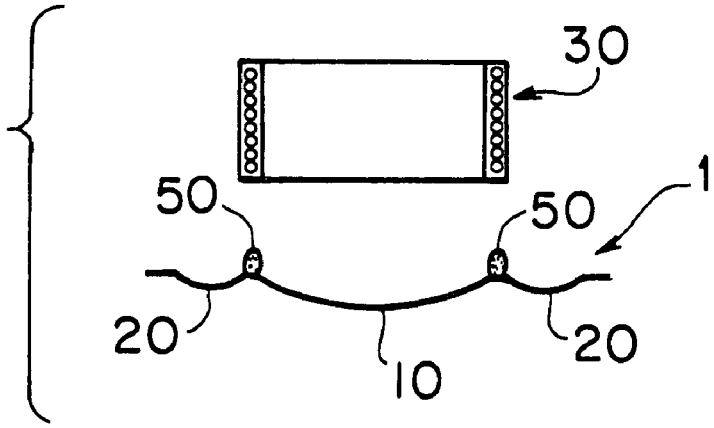
FIGS. 1*a*, 1*b*, 1*c*, 1*d* and 1*e* are views to explaining the steps of manufacturing a vibrating plate embodying the present invention.

In a manufacturing method of the vibrating plate, as a first step, the voice coil 30 is fixed on the center dome 10 of the vibrating plate with an adhesive as shown in FIG. 1*a*. In this case, from the viewpoint of shock-resistance, an ultraviolet curing-resin (a first ultraviolet curing-resin) 50 which has relatively high viscosity before hardening and relatively low hardness after hardening is used as the adhesive such that the voice coil 30 is prevented from being removed by a shock received from the outside.

It is preferable that the ultraviolet curing-resin 50 has a viscosity of 2000 cps±500 cps before hardening and a hardness of Shore D-scale 40±10 after hardening. For example, the product No.U-444 of CHEMITEC INC. can be exemplified as the ultraviolet curing-resin 50 which meets the property described above.

Figure 1B:
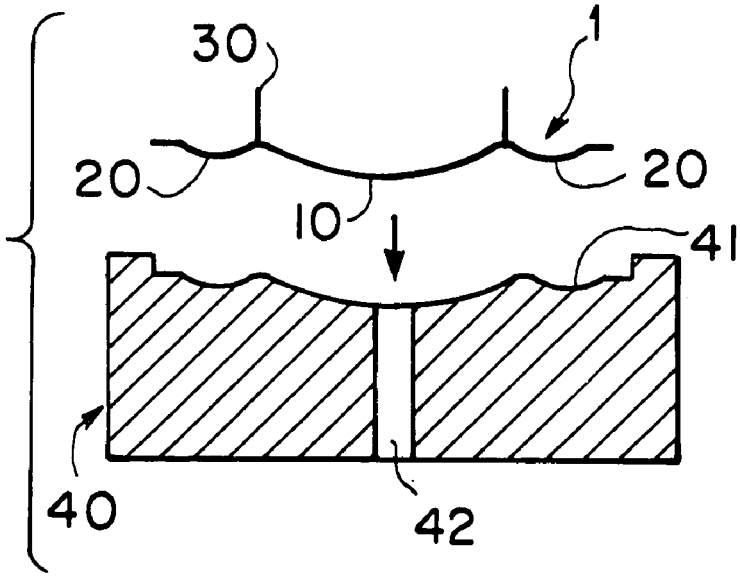

As a second step, as shown in FIG. 1*b*, the vibrating plate 1 is set on a rotating pedestal 40. A supporting surface 41 including concave surfaces fitting to convex surfaces of the center dome 10 and the sub-dome 20 is formed on the rotating pedestal 40. The vibrating plate 1 is placed upside down relating to the supporting surface 41, that is, the plate 1 is set with the concave surfaces of the center dome 10 and the sub-dome 20 facing up in FIG. 1*b*.

In this example, the center portion of the rotating pedestal 40 has a suction through-hole 42 communicating to a negative pressure source (not shown) so that the vibrating plate 1 is temporally fixed on the pedestal 40 by a sucking function of negative pressure. However, a clip or the like for pressing the edge of the vibrating plate 1 can be used as another fixing means.

Figure 1C:
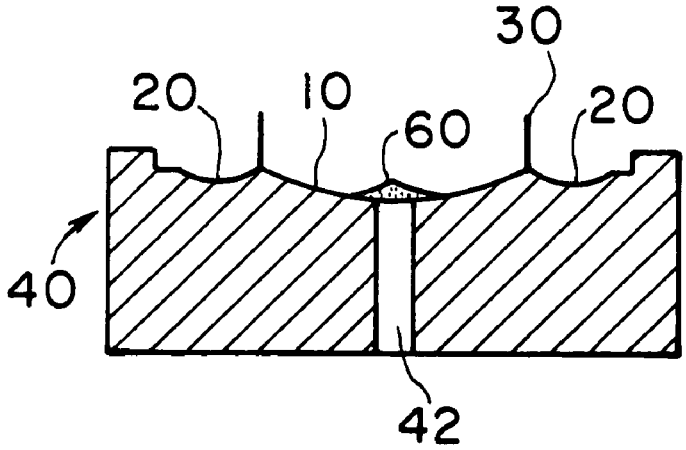

As a third step, as shown in FIG. 1*c*, an ultraviolet curing-resin (a second ultraviolet curing-resin) 60 which has relatively low viscosity before hardening and relatively high hardness after hardening is applied to form a reinforcing resin layer on the center dome 10. The ultraviolet curing-resin 60 can be applied from a dispenser-nozzle which is generally used. However, it is preferable that the applied position of the center dome 10 is the center lowest portion of the center dome 10. An amount of the application can be optionally determined due to the thickness of the reinforcing resin layer finally obtained and the area of the center dome 10 or the like.

It is preferable that the ultraviolet curing-resin 60 has a viscosity of 300 cps±100 cps before hardening and a hardness of Shore D-scale 80±20 after hardening. For example, the product No.U-1430 of CHEMITEC INC. can be exemplified as the ultraviolet curing-resin 60 which meets the property described above.

Figure 1D:
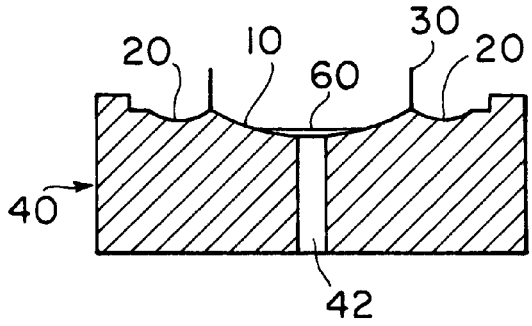

After the ultraviolet curing-resin 60 has been applied in the center portion of the inner surface of the center dome 10, before a next forth step, as show in FIG. 1*d*, it is preferable that the ultraviolet curing-resin 60 is left as it is in a predetermined time, for example, until the resin 60 spreads due to the wetting properties of the resin 60 without the rotation of the rotating pedestal so that the resin 60 conforms to the dome surface.

Figure 1E:
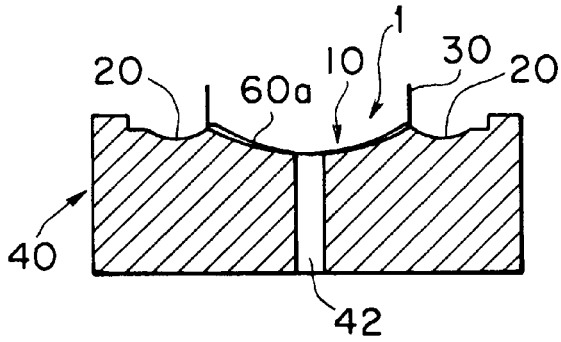

As the fourth step, the rotating pedestal 40 is rotated so that, as shown in FIG. 1*e*, the ultraviolet curing-resin 60 is spread on the whole inner surface of the center dome 10 and is formed to a thin film (a layer) by the centrifugal force.

In this case, it is preferable that a part of the ultraviolet curing-resin 60 spreads as far as the bonded portion between the center dome 10 and the voice coil 30 and covers the bonded portion in order to strengthen the bonding force of the center dome 10 and the voice coil. The rotation speed of the rotating pedestal 40 depends on the viscosity of the ultraviolet curing-resin 60. However, it is preferable that the rotating speed is 10 rpm to 500 rpm.

At a speed of less than 10 rpm, the ultraviolet curing-resin 60 may not spread equally as far as the bonded portion between the dome 10 and the coil 30 and, at a speed of more than 500 rpm, the stronger centrifugal force may cause the film in the center portion in the center dome to be extremely thinner or may form no film in the center portion in the center dome. Consequently, the speed of less than 10 rpm or more than 500 rpm is not preferable.

After it is confirmed that the ultraviolet curing-resin 60 has been formed to the thin film, as a fifth step, the thin film resin is harden by emitting ultraviolet rays with an ultraviolet light bulb (not shown) so that the thin film resin becomes the reinforcing resin layer 60*a*. It is preferable that, in order to obtain the equal hardness of the whole of the reinforcing resin layer 60*a*, the ultraviolet rays are emitted while the pedestal 40 is rotated. Next, the vibrating plate is removed by releasing the sucking function of negative pressure of the suction through-hole 42.

According to the invention, since the hard reinforcing resin layer 60*a* is integratedly formed in the inner surface of the center dome 10, the mechanical intensity of the center dome 10 is increased. The center dome 10 and the voice coil 30 are bonded together by the first ultraviolet curing-resin having relatively low hardness so that the coil 30 is not easily removed from the dome 10 due to the shock received from the outside. Further, the bonded portion between the dome and the coil is covered with the hard reinforcing layer 60*a* so that the bonding force is enhanced. Therefore, a frequency response of the microphone, especially in high frequency, is improved.

Figure 2:
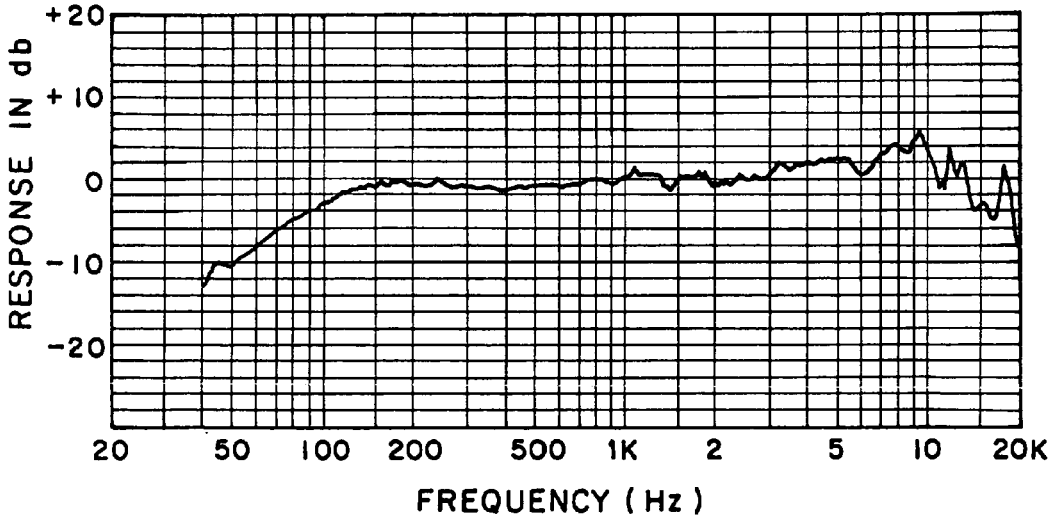
FIG. 2 is a graph to represent a frequency response of a dynamic microphone using the vibrating plate embodying the present invention.
Figure 3:
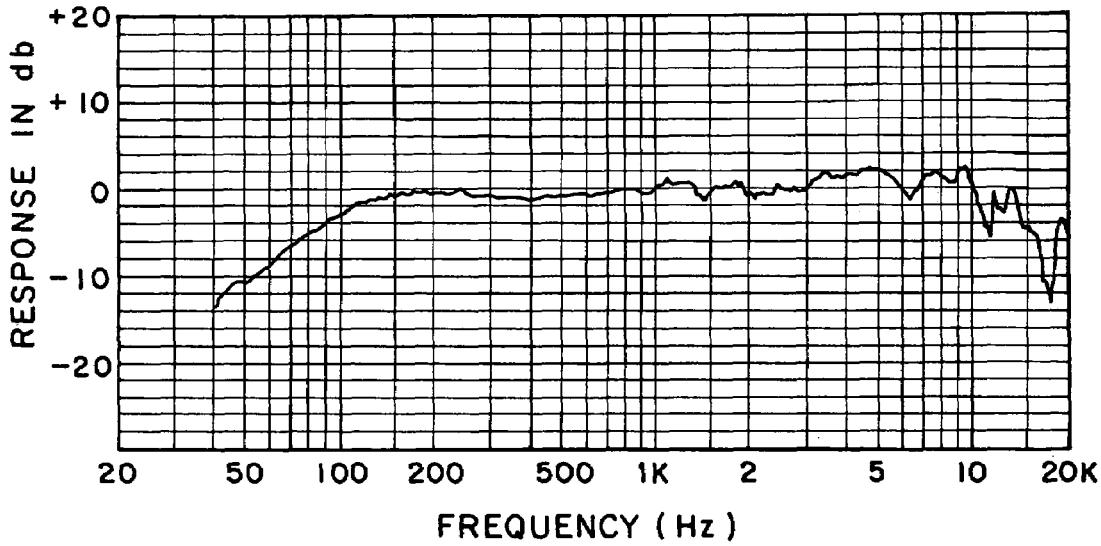
FIG. 3 is a graph to represent a frequency response of a dynamic microphone using a vibrating plate not embodying the present invention, FIG. 3 used for being compared with the frequency response in FIG. 2 of the microphone using the vibrating plate of the invention.

FIG. 2 shows the frequency response of the dynamic microphone using the vibrating plate of the present invention. The vibrating plate has a diameter of 27 mm and the center dome 10 has a diameter of 14 mm, and the center dome 10 and the voice coil 30 are bonded together with the product No.U-444 of CHEMITEC INC. The reinforcing resin layer 60*a* having a thickness of 10 μm formed with the product No.1430 of CHEMITEC INC. covers the bonded portion between the dome 10 and the coil 30. FIG. 3 shows a frequency response of a dynamic microphone using a vibrating plate. The vibrating plate having the same structure as that of the invention has a diameter of 27 mm and has a center dome having a diameter of 14 mm, and the center dome and a voice coil are bonded together with the product No.U-444 of CHEMITEC INC. However, no thin film is formed on the inner surface of the center dome.

It is observable that the frequency response of FIG. 2 in the vicinity of 20 kHz is improved by approximate 2 db compared with that of FIG. 3. The manufacturing steps of the vibrating plate explained by FIGS. 1*a* to 1*e* can be automatized so that the dynamic microphones having stable quality are manufactured at low costs.

The invention claimed is:

1. A vibrating plate of a dynamic microphone including a center dome and a sub-dome connecting and communicating with the outer circumference of the center dome, the center dome fixing an electricity generating voice coil through an adhesive, the vibrating plate of the dynamic microphone comprising:

wherein a first ultraviolet curing-resin is used as the adhesive for bonding the voice coil to the center dome, the first ultraviolet curing-resin having relatively high viscosity before hardening and relatively low hardness after hardening; and a second ultraviolet curing-resin integratedly formed on the inner surface of the center dome as a reinforcing resin layer, the second ultraviolet curing-resin having relatively low viscosity before hardening and relatively high hardness after hardening.

2. A vibrating plate of a dynamic microphone according to claim 1, wherein the first ultraviolet curing-resin has a viscosity of 2000 cps±500 cps before hardening and a hardness of Shore D-scale 40±10 after hardening and the second ultraviolet curing-resin has a viscosity of 300 cps±100 cps before hardening and a hardness of Shore D-scale 80±20 after hardening.

3. A vibrating plate of a dynamic microphone according to claim 2, wherein the second ultraviolet curing-resin is formed as to cover the bonded portion between the voice coil and the center dome.

4. A dynamic microphone comprising the vibrating plate according to claim 2.

5. A vibrating plate of a dynamic microphone according to claim 1, wherein the second ultraviolet curing-resin is formed as to cover the bonded portion between the voice coil and the center dome.

6. A dynamic microphone comprising the vibrating plate according to claim 5.

7. A dynamic microphone comprising the vibrating plate according to claim 1.

8. A method of manufacturing a vibrating plate of a dynamic microphone including a center dome and a sub-dome connecting and communicating with the outer circumference of the center dome, the center dome fixing an electricity generating voice coil through an adhesive, the method of manufacturing the vibrating plate of the dynamic microphone comprising the step of:

fixing the voice coil to the center dome by a first ultraviolet curing-resin, the first ultraviolet curing-resin having relatively high viscosity before hardening and relatively low hardness after hardening;

temporally fixing the vibrating plate with the voice coil on a rotating pedestal with predetermined fixing means with the inner surface of the vibrating plate facing up;

applying a second ultraviolet curing-resin on the center portion of the inner surface of the center dome, the second ultraviolet curing-resin having relatively low viscosity before hardening and relatively high hardness after hardening;

spreading the second ultraviolet curing-resin along the inner surface of the center dome to form a thin film by the centrifugal force with the rotating pedestal rotated; and hardening the second ultraviolet curing-resin formed to the thin film to form a reinforcing resin layer by emitting ultraviolet rays.

9. A method of manufacturing a vibrating plate of a dynamic microphone according to claim 8, wherein the method further comprises the step of conforming the second ultraviolet curing-resin to the inner surface of the center dome due to leaving the resin spreading in a predetermined time without the rotation of the rotating pedestal, the step executed between the step of applying the second ultraviolet curing-resin on the center portion of the inner surface of the center dome and the step of spreading the second ultraviolet curing-resin along the inner surface of the center dome.

10. A method of manufacturing a vibrating plate of a dynamic microphone according to claim 9, wherein the step of spreading the second ultraviolet curing-resin along the inner surface of the center dome to form the thin film is executed while the vibrating plate is rotated at a rotating speed of 10 rpm to 500 rpm.

11. A method of manufacturing a vibrating plate of a dynamic microphone according to claim 9, wherein the step of hardening the second ultraviolet curing-resin to form the reinforcing resin layer by emitting ultraviolet rays is executed while the rotating pedestal is rotated.

12. A method of manufacturing a vibrating plate of a dynamic microphone according to claim 8, wherein the step of spreading the second ultraviolet curing-resin along the inner surface of the center dome to form the thin film is executed while the vibrating plate is rotated at a rotating speed of 10 rpm to 500 rpm.

13. A method of manufacturing a vibrating plate of a dynamic microphone according to claim 12, wherein the step of hardening the second ultraviolet curing-resin to form the reinforcing resin layer by emitting ultraviolet rays is executed while the rotating pedestal is rotated.

14. A method of manufacturing a vibrating plate of a dynamic microphone according to claim 8, wherein the step of hardening the second ultraviolet curing-resin to form the reinforcing resin layer by emitting ultraviolet rays is executed while the rotating pedestal is rotated.

* * * * *